US010283843B2

(12) United States Patent
Sayem et al.

(10) Patent No.: US 10,283,843 B2
(45) Date of Patent: May 7, 2019

(54) ANTENNA SYSTEM INCLUDING CLOSELY SPACED ANTENNAS ADAPTED FOR OPERATING AT THE SAME OR SIMILAR FREQUENCIES

(71) Applicant: Motorola Mobility LLC, Chicago, IL (US)

(72) Inventors: Abu Sayem, Aurora, IL (US); Ugur Olgun, Chicago, IL (US); Mohammed Abdul-Gaffoor, Palatine, IL (US); John Mura, Clarendon Hills, IL (US); Minh Duong, Lake Bluff, IL (US)

(73) Assignee: Motorola Mobility LLC, Chicago, IL (US)

( * ) Notice: Subject to any disclaimer, the term of this patent is extended or adjusted under 35 U.S.C. 154(b) by 148 days.

(21) Appl. No.: 15/235,757

(22) Filed: Aug. 12, 2016

(65) Prior Publication Data

US 2018/0048050 A1 Feb. 15, 2018

(51) Int. Cl.
*H01Q 1/24* (2006.01)
*H01Q 9/42* (2006.01)
(Continued)

(52) U.S. Cl.
CPC ..... *H01Q 1/243* (2013.01); *H01Q 5/328* (2015.01); *H01Q 9/42* (2013.01); *H01Q 21/28* (2013.01)

(58) Field of Classification Search
None
See application file for complete search history.

(56) References Cited

U.S. PATENT DOCUMENTS 9,484,631 B1 * 11/2016 Napoles ..... H01Q 1/243
9,801,006 B2 * 10/2017 Olgun ..... H01Q 1/243
(Continued)

OTHER PUBLICATIONS

Ugur Olgun, et al., "NFC Antenna Architecture for Mobile Communication Device with Single-Piece Metal Housing", U.S. Appl. No. 14/824,240, filed Aug. 12, 2015.
(Continued)

*Primary Examiner* — Trinh V Dinh
(74) *Attorney, Agent, or Firm* — Lawrence J. Chapa

(57) ABSTRACT

The present application provides an antenna system for use in an electronic device. The antenna system includes a conductive housing for the electronic device having a perimeter, which extends around the device. The conductive housing has a plurality of arms formed in the conductive housing at or near the perimeter. The antenna system further includes a conductive substrate, coupled to the conductive housing and located within the perimeter of the conductive housing. The conductive substrate has a notch located proximate the position of one of the plurality of arms in the conductive housing, where each of the plurality of arms respectively couples to the conductive substrate proximate the perimeter, and where the notch causes one of the plurality of arms to couple to the conductive substrate at a point having a different relative distance along the length of the perimeter of the conductive housing. The antenna system still further includes a plurality of signal sources, respectively coupled between the conductive substrate and a corresponding one of the plurality of arms. In at least some or other embodiments a selectable shunt circuit can be used to affect the polarization of the wireless signals associated with one or more of the antenna arms.

18 Claims, 3 Drawing Sheets

(51) Int. Cl.
*H01Q 21/28* (2006.01)
*H01Q 5/328* (2015.01)

(56) References Cited

U.S. PATENT DOCUMENTS

| | | | | |
|---|---|---|---|---|
| 2004/0257283 | A1* | 12/2004 | Asano | H01Q 1/243 343/702 |
| 2013/0050046 | A1* | 2/2013 | Jarvis | H01Q 1/243 343/852 |
| 2015/0288053 | A1* | 10/2015 | Saxe | H01Q 1/243 343/702 |
| 2016/0226130 | A1 | 8/2016 | Allore et al. | |
| 2016/0301139 | A1 | 10/2016 | Lombardi et al. | |
| 2016/0381618 | A1* | 12/2016 | Sayem | H01Q 1/243 370/329 |
| 2017/0048649 | A1* | 2/2017 | Olgun | H01Q 1/243 |
| 2017/0098951 | A1* | 4/2017 | Olgun | H02J 7/025 |

OTHER PUBLICATIONS

Ugur Olgun, et al., "Wireless Charging Architecture for Mobile Communication Device with Single-Piece Metal Housing", U.S. Appl. No. 14/872,322, filed Oct. 1, 2015.

Jun Zhao, et al., "One Piece Conductive Housing with Incorporated Antenna for Use in an Electronic Device", U.S. Appl. No. 15/235,065, filed Aug. 11, 2016.

* cited by examiner

ANTENNA SYSTEM INCLUDING CLOSELY SPACED ANTENNAS ADAPTED FOR OPERATING AT THE SAME OR SIMILAR FREQUENCIES

FIELD OF THE APPLICATION

The present disclosure relates generally to electronic devices with an antenna, and more particularly, electronic devices incorporating a polarization agile antenna and/or closely spaced antennas with reduced correlation.

BACKGROUND

Electronic devices, such as smartphones, are increasingly supporting use cases, where for certain functionality, it is desirable for the device to be able to support a larger display size. For example, larger display sizes can be desirable for viewing visual content as part of a media player or a browser, as well as for supporting the visual presentation of information as part of an application or program that is being executed by the device. However, such a trend needs to be balanced with a general desire for the overall size of the device to stay the same and even decrease in one or both of dimension and weight.

In an attempt to support larger display sizes without increasing the overall size of the device, device manufacturers have increasingly dedicated a larger percentage of the exterior surface to a display, where the display in many instances has grown in one or more dimensions to a size that dominates a particular surface, such as the front surface of the device. In at least some of these instances, the display has been allowed to extend into areas that had previously been used to support user inputs, such as areas of the surface that have previously supported a keypad, such as a numeric keypad.

Larger displays often mean larger openings in the housing, which can reduce the amount of material that is available to support the structural integrity of the housing, and correspondingly the device. As such, manufacturers are increasingly relying upon materials in the formation of the device housings, such as metals, that have historically better maintained structural integrity with less overall material. This is true for devices having a full metal rear housing, as well as devices that incorporate perimeter metal housings. However, housings made from conductive materials, such as metal, can interfere with the transmission and reception of wireless signals into and out of the device. Further openings can be made in the housing proximate the location of the antennas, which support wireless communication signal transmission/reception, in order to create an area through which wireless signaling can propagate. Alternatively, the antennas can be formed into the housing materials with cuts and/or further openings which isolate the antenna portions from the non-antenna portions of the housing. However, to the extent that cuts or further openings need to be made in the housing, the further openings and/or cuts can further affect the structural integrity. The further openings and/or cuts can also affect the aesthetics of the device.

Furthermore, to the extent that one or multiple antenna(s) are formed in the housing, the size and shape of the housing of the device can affect the size, shape and spacing of the corresponding antenna(s). This in turn can affect the ability of multiple antennas associated with a conductive housing to operate together at the same or similar frequencies including instances in which there is a desire for multiple antennas to support antenna diversity in support of wireless radio frequency communications.

The present innovators have recognized that by controlling the geometry of the antenna elements formed in a housing, as well as the interaction of the antenna elements, including the higher current portions of the antenna elements, with a conductive substrate, one can affect the polarity of the signals that are more optimally transmitted or received by the structure. In turn the relative differences in polarity of the more optimally transmitted and received signals by the various antenna structures can help to reduce the correlation between relatively closely spaced antennas in support of antenna diversity in a hand-held sized device.

SUMMARY

The present application provides an antenna system for use in an electronic device. The antenna system includes a conductive housing for the electronic device having a perimeter, which extends around the device. The conductive housing has a plurality of arms formed in the conductive housing at or near the perimeter. The antenna system further includes a conductive substrate, coupled to the conductive housing and located within the perimeter of the conductive housing. The conductive substrate has a notch located proximate the position of one of the plurality of arms in the conductive housing, where each of the plurality of arms respectively couples to the conductive substrate proximate the perimeter, and where the notch causes one of the plurality of arms to couple to the conductive substrate at a point having a different relative distance along the length of the perimeter of the conductive housing. The antenna system still further includes a plurality of signal sources, respectively coupled between the conductive substrate and a corresponding one of the plurality of arms.

In at least one embodiment, the notch directs return current for a signal source of the plurality of signal sources coupled between the conductive substrate and the arm associated with the notch in a direction which affects the polarity of the radiated energy transmitted and received via the arm associated with the notch.

The present application further provides an antenna system for use in an electronic device. The antenna system includes a conductive substrate having a main body and at least one conductive arm. Each conductive arm has two ends. One of the two ends of the conductive arm is coupled to the main body, and a conductive portion extends between the two ends of the arm and extends away from the main body of the conductive substrate. The antenna system further includes one or more signal sources. Each signal source is associated with a corresponding conductive arm, where the signal source is coupled between the main body of the conductive substrate and a point proximate the end of the two ends of the corresponding conductive arm that is not coupled to the main body. The conductive portion of the at least one conductive arm that extends between the two ends of the at least one conductive arm includes a first section extending along a length in a first direction, and a second section extending along a length in a second direction which is different than the first direction, where the second direction has at least a component of extension that is orthogonal to the first direction of extension of the first section. The second section of the at least one conductive arm is coupled to the main body of the conductive substrate at one end of the at least one conductive arm that coincides with one end of the second section. The second section of the at least one conductive arm includes a selective second point of coupling to the main body of the conductive substrate via a controllable selectable shunt circuit located at a point along the length of the second section that is away from the end of the second section that is coupled to the main body.

In at least one embodiment, the at least one conductive arm is located proximate a corner of the main body of the conductive substrate, where the first section extends in a direction consistent with a first external side of the main body of the conductive substrate proximate an outer perimeter of the main body and the second section extends in a direction consistent with a second external side of the main body of the conductive substrate proximate the outer perimeter of the main body.

These and other features, and advantages of the present disclosure are evident from the following description of one or more preferred embodiments, with reference to the accompanying drawings.

DETAILED DESCRIPTION OF THE PREFERRED EMBODIMENT(S)

Figure 2:
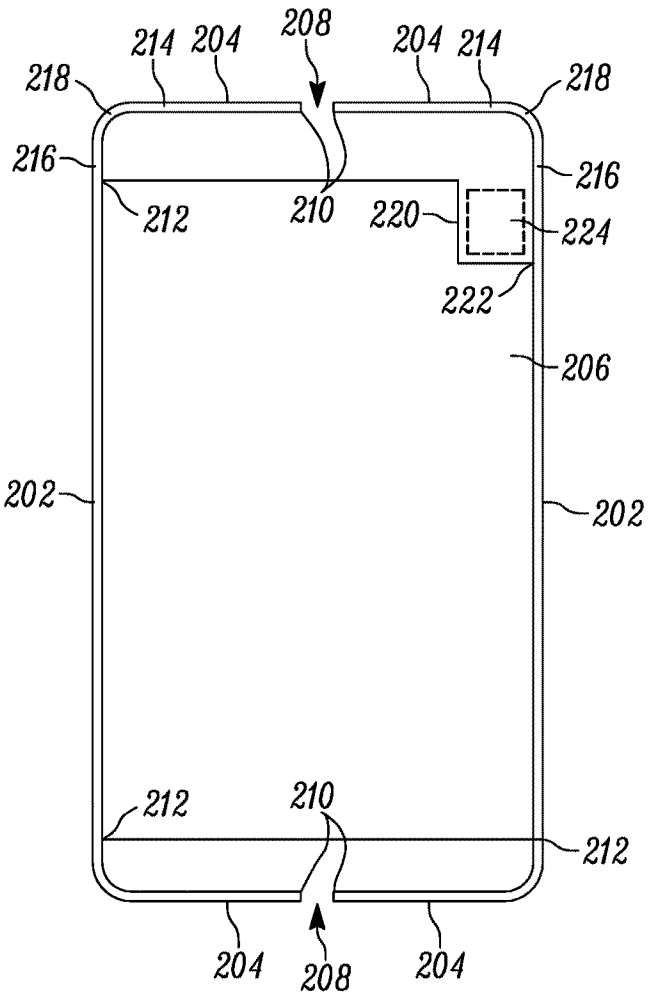
FIG. 2 is a front view of a perimeter conductive housing with a plurality of arms formed as part of the same, and a conductive substrate.

While the present invention is susceptible of embodiment in various forms, there is shown in the drawings and will hereinafter be described presently preferred embodiments with the understanding that the present disclosure is to be considered an exemplification and is not intended to limit the invention to the specific embodiments illustrated. One skilled in the art will hopefully appreciate that the elements in the drawings are illustrated for simplicity and clarity and have not necessarily been drawn to scale. For example, the dimensions of some of the elements in the drawings may be exaggerated relative to other elements with the intent to help improve understanding of the aspects of the embodiments being illustrated and described.

Figure 1:
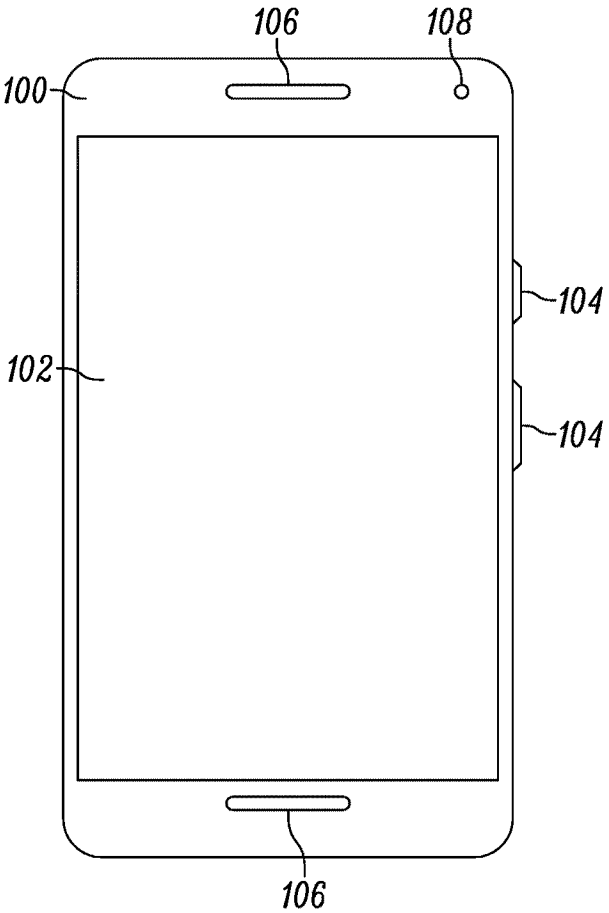
FIG. 1 is a front view of an exemplary wireless communication device.

FIG. 1 illustrates a front view of an exemplary wireless communication device 100, such as a wireless communication device. While in the illustrated embodiment, the type of wireless communication device shown is a radio frequency cellular telephone, other types of devices that include wireless radio frequency communication capabilities are also relevant to the present application. In other words, the present application is generally applicable to wireless communication devices beyond the type being specifically shown. A couple of additional examples of suitable wireless communication devices that may additionally be relevant to the present application in the incorporation and management of an antenna as part of the housing can include a tablet, a laptop computer, a desktop computer, a netbook, a cordless telephone, a selective call receiver, a gaming device, a personal digital assistant, as well as any other form of wireless communication device that might be used to manage wireless communications including wireless communications involving one or more different communication standards. A few examples of different communication standards include Global System for Mobile Communications (GSM) Code Division Multiple Access (CDMA), Orthogonal Frequency Division Multiple Access (OFDMA), Long Term Evolution (LTE), Global Positioning System (GPS), Bluetooth®, Wi-Fi (IEEE 802.11), Near Field Communication (NFC) as well as various other communication standards. In addition, the wireless communication device 100 may utilize a number of additional various forms of communication including systems and protocols that support a communication diversity scheme, as well as carrier aggregation and simultaneous voice and data that concurrently enables the use of simultaneous signal propagation.

In the illustrated embodiment, the radio frequency cellular telephone includes a display 102 which covers a large portion of the front facing. In at least some instances, the display can incorporate a touch sensitive matrix, that can help facilitate the detection of one or more user inputs relative to at least some portions of the display, including an interaction with visual elements being presented to the user via the display 102. In some instances, the visual element could be an object with which the user can interact. In other instances, the visual element can form part of a visual representation of a keyboard including one or more virtual keys and/or one or more buttons with which the user can interact and/or select for a simulated actuation. In addition to one or more virtual user actuatable buttons or keys, the device 100 can include one or more physical user actuatable buttons 104. In the particular embodiment illustrated, the device has two such buttons located along the right side of the device.

The exemplary hand held electronic device, illustrated in FIG. 1, additionally includes a pair of speakers 106. The speakers 106 may support the reproduction of an audio signal, which could be associated with an ongoing voice communication or the playback of a streaming or stored media file, which can include a stand-alone signal, such as for use in the playing of music, or can be part of a multimedia presentation, such as for use in the playing of a movie, which might have at least an audio as well as a visual component. One or more of the speakers may also include the capability to also produce a vibratory effect. However, in some instances, the purposeful production of vibrational effects may be associated with a separate element, not shown, which is internal to the device.

In the present instance a pair of speakers can support the reproduction of stereophonic sound including both a left and a right channel associated with when the device is oriented in landscape mode, such as for viewing the playback of a movie. Otherwise, at least one of the speakers is located toward the top of the device, which corresponds to an orientation consistent with the respective portion of the device facing in an upward direction during usage in support of a voice communication. In such an instance, at least a corresponding one of the speakers 106 might be intended to align with the ear of the user, and at least one of one or more microphones (not shown) might be intended to align with the mouth of the user, which is often generally opposite the corresponding speaker 106 at a location at or proximate the bottom of the device. Also located near the top of the device, in the illustrated embodiment, is a front facing camera 108. The wireless communication device will also generally include one or more radio frequency transceivers, as well as associated transmit and receive circuitry, including one or more antennas that may be incorporated as part of the housing of the device 100.

FIG. 2 illustrates a front view 200 of a perimeter conductive housing 202 with a plurality of arms 204 formed as part of the same, and a conductive substrate 206. The conductive housing 202 has a perimeter that extends around the device, where in at least some instance the perimeter forms at least part of a sidewall of the device. The conductive substrate 206 is coupled to the conductive housing 202. The arms 204 are formed as part of portions of the perimeter of the conductive housing 202 that extends beyond the conductive substrate 206. Each portion of the perimeter that extends beyond the conductive substrate can be separated into multiple arms by a gap 208 in the perimeter, which in at least some instances can mark the end of a pair of respective arms 204. In other words, the arms often generally have two ends, one end 210 that coincides with the gap 208 in the perimeter and an end 212 which is proximate the point that the uncoupled portion of the perimeter meets the conductive substrate 206.

In at least some instances, an arm 204 can have two sections, a first section 214 that extends along the side of the device 100 in a first direction, and a second section 216 that extends along the side of the device 100 in a second direction. In the illustrated embodiment, the change in direction of the arm coincides with a corner 218 of the device, where the perimeter of the device similarly changes direction. Furthermore, in at least some instances, the conductive substrate can include a notch 220, which can affect the point 222 along the length of the perimeter at which the conductive housing 202 meets with the conductive substrate 206. In turn, the notch 220 can affect the length of the arm 204 including the length of at least one 216 of the two sections.

In at least some instances, the formation of the conductive housing 202 includes metal(s) and/or a metal alloy, which coincides with the surrounding sidewall of the device 100. Openings can exist in the sidewall, which allows for the formation of arms, as well as the inclusion of features such as the placement of physical user actuatable buttons 104, as well as various other porting such as headphone jack, microphone ports, and memory card slots. In some instances, some of the openings, such as the openings which define the shape of the arms 204, can be filled in with a nonconductive material such as a plastic type material.

The conductive substrate 206 in at least some instances can be part of a printed circuit substrate, such as in the form of a ground plane and/or a circuit shield. The printed circuit substrate can be used to receive electrical elements including electronic circuitry, components and/or modules, as well as conductive traces for interconnecting the electrical elements. While a notch 220 in the conductive substrate 206 can affect the point 222 at which one end of an arm 204 couples to the same, the notch 220 can also provide greater clearance for the placement of some circuit elements. There is an overall trend for relatively thin devices 100. As such, there is a desire to minimize the overall thickness of the device 100. Within this space a stack up including various combinations of components including the display, electronic circuitry, and power storage, such as a battery, often need to be accommodated. In some instances, larger circuit elements 224 can be made to better fit within the overall width of the device 100 by eliminating the circuit substrate 206 relative to at least some portions of the device 100. For example, in some instances a card reader sub-assembly, such as a micro SD card reader, can be more readily received within the device 100 in an area associated with a notch 220, where the conductive substrate 206 does not extend.

In the illustrated embodiment, the conductive housing 202, and correspondingly the device 100 is substantially rectangular in shape. The overall shape of the conductive substrate 206 is similarly largely rectangular. However, while many of the overall shapes in the illustrated embodiment are substantially rectangular in shape, there is no requirement that their shapes be rectangular. Alternative shapes are possible without diverging from the teachings of the present application including other instances where the arms 204 formed in the conductive housing 202 include a section, which have a change in the direction of extension that deviates from a first direction of extension associated with another portion of the arm.

Figure 3:
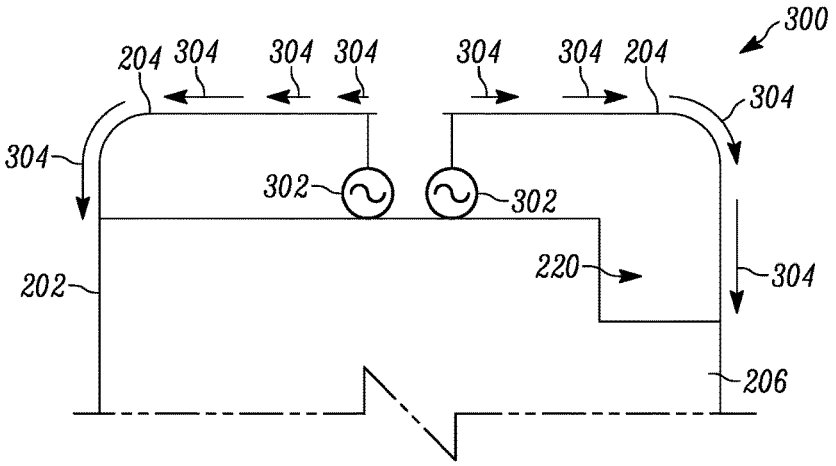
FIG. 3 is a partial schematic view of the conductive housing with a plurality of arms, and the conductive substrate.

FIG. 3 illustrates a partial schematic view 300 of the conductive housing 202 with a plurality of arms 204, and the conductive substrate 206 from which an antenna system can be formed. In the illustrated embodiment, signal sources 302 are respectively shown being applied across the conductive substrate 206 and a corresponding one of the arms 204. More specifically, the signal source 302 is coupled to the arm 204 proximate the end of the corresponding arm 204 that is not more directly coupled to the conductive substrate 206. In the illustrated embodiment, the portion of the conductive housing 202 forming an arm 204 forms an antenna structure capable of receiving radiated energy having a compatible frequency. In combination with a signal source 302, the same antenna structure is further capable of transmitting a radiated energy signal at a compatible frequency. At least some of the compatible frequencies corresponds to a set of frequencies, whereby the arm has a length which functions as a quarter wave antenna.

In the illustrated embodiment, an alternating current (AC) signal having a sinusoidal waveform with a varying voltage differential is applied by the signal source between the conductive substrate 206 and the end of the arm 204. At a compatible frequency, the signal applied by the signal source will produce a standing wave, whereby a current will be induced in the antenna structure which will vary depending upon the distance along the arm 204 relative to the point where the signal is applied to the arm 204 by the source 302. In the illustrated embodiment, a standing wave produced in the quarter wave antenna structure will produce greater currents in the arm 204 towards the end of the arm 204 that more directly couples to the conductive substrate 206. Differing size arrows 304 help to illustrate the magnitude of the currents produced at different points along the length of the arm 204 from a standing wave produced by an AC signal having a compatible frequency applied to the end of the arm 204 by the signal source 302.

Antenna diversity includes the use of two or more antennas to improve the reliability and quality of a wireless communication connection. In theory, relative to a particular wireless communication connection, each antenna will have a different transmission path, where each path will have a unique set of phase shifts, time delays, attenuations and distortions. Distortions, attenuations, time delays and phase shifts that may be present in one of the transmission paths, that may hinder the desired transmission or receipt of a particular communication signal, may not be present in the other path. In essence, the multiple antennas will each have a separate chance to observe the signal. However in order for diversity to be effective, the antennas must each be associated with a sufficiently distinct path, such that negative effects in one of the paths is not significantly represented in the other paths. In other words, there should be a sufficiently low correlation between the multiple antennas, which are intended to support diversity.

At least one manner of reducing the correlation between multiple antennas is to provide sufficient spatial separation. However in a handheld wireless communication device 100, the size of the device does not always allow for a meaningful distance between multiple antennas. Where spatial diversity may be insufficient, antenna diversity systems can sometimes make use of pattern diversity and/or polarization diversity. In the present embodiment, the inclusion of the notch 220 in the conductive substrate 206 relative to at least one of the arms 204 affects the corresponding length of that arm 204 including the length of the portion of the arm 204 further away from the point of coupling to the signal source 302. The portion 216 of the arm 204 where the length is increased further corresponds to the portion 216 of the arm 204 where the currents are larger for certain frequencies. Furthermore, in the illustrated embodiment, the additional length in the arm 204 associated with the notch 220 is in a section 216 that is on the opposite side of a corner 218, where the arm 204 changes direction so as to have a substantial component that extends in a direction that is perpendicular to the direction of extension in the section 214 prior to the bend of the arm 204 at the corner 218. In turn this can have a meaningful affect on the resulting polarity of the signal that is best being transmitted and received by the antenna structure, when compared to a same or similar signal being applied to another arm that does not have the additional length due to an absence of a corresponding notch in the proximate portion of the conductive substrate. Moving more of the related current in the antenna to a portion of the antenna located after the bend has an effect on the more optimal polarity of the more readily transmitted and received signals.

Figure 4:
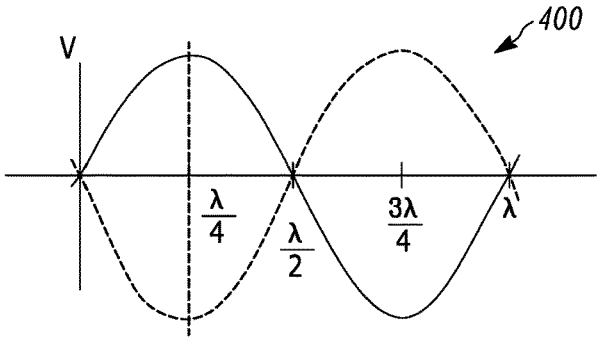
FIG. 4 is a graph of a standing wave having a wavelength of lambda.

FIG. 4 illustrates a graph of a standing wave 400 having a wavelength of lambda, wherein the corresponding amplitude at any distance along the wavelength between zero and lambda, anticipates the degree to which the voltage will vary, as the magnitude of the signal being applied at the source changes. It is noted that the illustration shows the amplitude of the standing wave beyond the quarter wavelength. While the present invention has been largely described in connection with quarter wavelength antennas, the beneficial teachings of the present application are believed to also be applicable to other antennas, which correspond to other than quarter wavelength antennas. Correspondingly, an understanding where the changes in voltage and correspondingly the current flow will be largest is beneficial relative to managing the relative polarity of the wireless signals being produced by the alternative structure.

Figure 5:
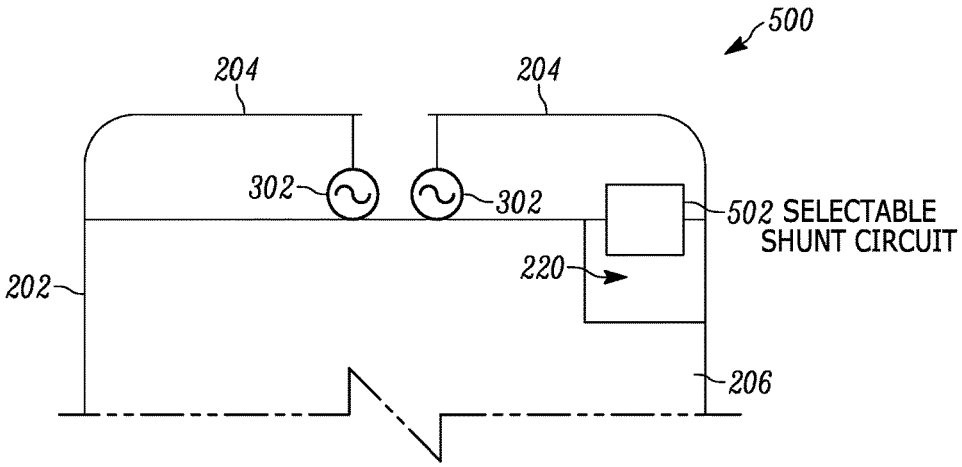
FIG. 5 is a partial schematic view of the conductive housing with a plurality of arms, and the conductive substrate with a selectable shunt circuit.

FIG. 5 illustrates a partial schematic view 500 of the conductive housing with a plurality of arms 204, and the conductive substrate 206 with a selectable shunt circuit 502. Similar to the embodiment illustrated in FIG. 3, a conductive housing 202 with a plurality of arms 204, and the conductive substrate 206, from which an antenna system can be formed, are shown. Furthermore, signal sources 302 are respectively shown being applied across the conductive substrate 206 and a corresponding one of the arms 204. While the conductive substrate 206 similarly includes a notch 220 proximate where one of the arms 204 would couple to the conductive substrate 206, the present embodiment further includes a selectable shunt circuit 502, which can be used to selectively couple the arm 204 associated with the notch 220 to the conductive substrate 206 more proximate a location that the arm 204 would couple to the conductive substrate 206 if the notch 220 were not present.

In at least some embodiments, the selectable shunt circuit 502 would appear to the signal source 302 to be electrically equivalent to the additional length of arm 204 associated with the presence of the notch 220, so that the signal source 302 would see a substantially equivalent electrical structure whether the selectable shunt circuit 502 was either acting as a shunt or not acting as a shunt. However, while the additional length of the arm 204 is part of the antenna structure as a radiating structure, the selectable shunt circuit 502 when shunting is intended to cause currents in the arm 204 to be redirected, but the selectable shunt circuit 502 may not be intended to act as a radiating structure. In turn, the selectable shunt circuit 502 can be used to make the antenna system at least somewhat polarization agile. At least one example of a suitable selectable shunt circuit 502 includes an inductor capacitor tank circuit.

Figure 6:
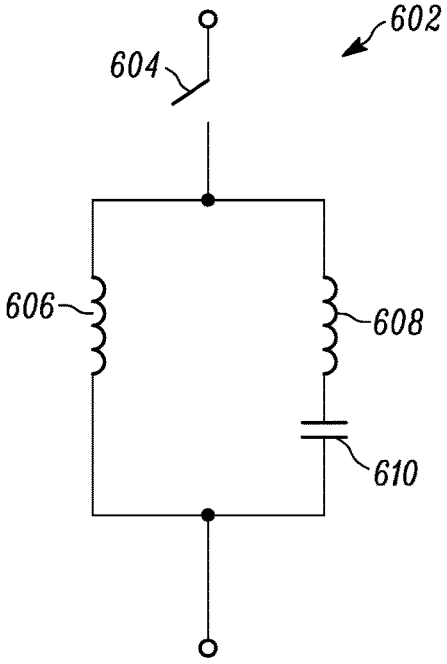
FIG. 6 is a schematic view of a selectable shunt circuit.

FIG. 6 illustrates a schematic view of a selectable shunt circuit 602. The selectable shunt circuit 602 includes a switch 604, which can be used to control whether the circuit is acting as a shunt (switch closed) or not (switch open). The switch 604 is in series with the combination of an inductor 606 in parallel with the series combination of an inductor 608 and a capacitor 610. The values of the capacitor 610 and the inductors 606 and 608 can be selected to make the selectable shunt circuit 602 appear substantially electrically equivalent at one or more frequencies of interest to the portion of the arm 204 proximate the notch 220 that is being shunted by the selectable shunt circuit 602.

Figure 7:
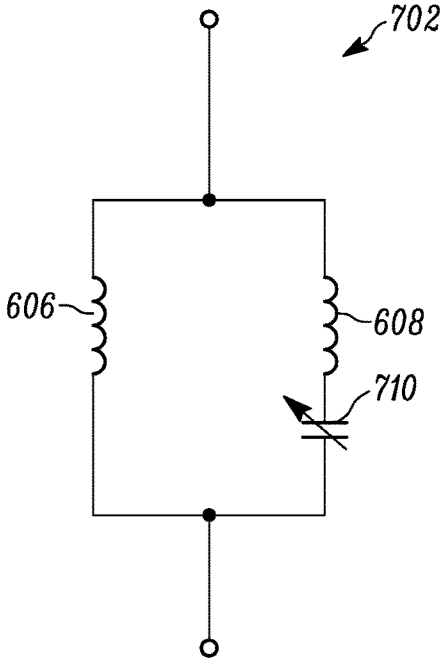
FIG. 7 is a schematic view of a further selectable shunt circuit.

In an alternative embodiment, FIG. 7 illustrates a schematic view of a further selectable shunt circuit 702. The selectable shunt circuit 702, illustrated in FIG. 7, replaces the capacitor 610 with a variable capacitor 710, which allows the switch 604 to be eliminated. The variable capacitor 710 can be used to selectively tune and detune the selectable shunt circuit 702, so as to control the ability of the circuit to function as a shunt depending upon the frequency of the signal being transmitted or received.

The selectable shunt circuits 602 and 702 can be used to affect the polarity of the antenna structure corresponding to the arm 204 associated with the notch 220. However, even with the selective shunt circuit 602 or 702 being active, which may effectively eliminate substantial differences in polarization, the antennas may still have some degree of decorrelation, as a result of differences in the angle at which each of the antennas are looking. In turn, the antenna structure may still provide some degree of effective form of diversity despite being closely spaced and not having a difference in polarity.

While the preferred embodiments have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. An antenna system for use in an electronic device, the antenna system comprising:

a conductive housing for the electronic device having a perimeter, which extends around the device, the conductive housing having a plurality of arms formed in the conductive housing at or near the perimeter;

a conductive substrate, coupled to the conductive housing and located within the perimeter of the conductive housing, the conductive substrate having a notch located proximate a position of one of the plurality of arms in the conductive housing, where each of the plurality of arms respectively couples to the conductive substrate proximate the perimeter, and where the notch causes one of the plurality of arms to couple to the conductive substrate at a point having a different relative distance along the length of the perimeter of the conductive housing than if the notch had not been present; and a plurality of signal sources, respectively coupled between the conductive substrate and a corresponding one of the plurality of arms.

2. An antenna system in accordance with claim 1, wherein the plurality of arms formed in the conductive housing includes a pair of arms located at or near the top of the housing.

3. An antenna system in accordance with claim 2, wherein each arm in the pair of arms extend from a respective one of opposite sides of the conductive housing proximate the perimeter, and extends along the perimeter toward the other arm in the pair of arms toward the middle of a side of the conductive housing which extends between the opposite sides.

4. An antenna system in accordance with claim 3, wherein a space between the ends of the arms in the pair of arms forms a gap, where the gap is filled in with a nonconductive material.

5. An antenna system in accordance with claim 2, wherein the plurality of arms formed in the conductive housing additionally includes a second pair of arms located at or near the bottom of the housing.

6. An antenna system in accordance with claim 1, wherein the notch directs return current for a signal source of the plurality of signal sources coupled between the conductive substrate and the arm associated with the notch in a direction which affects the polarity of the radiated energy transmitted and received via the arm associated with the notch.

7. An antenna system in accordance with claim 6, wherein the differences in polarity of the radiated energy transmitted and received via each of the arms between the arm associated with the notch and an arm not associated with the notch can support antenna diversity.

8. An antenna system in accordance with claim 1, wherein the conductive substrate is at least part of a printed circuit substrate including a conductive ground plane.

9. An antenna system in accordance with claim 1, wherein the notch coincides with the location of a card reader.

10. An antenna system in accordance with claim 1, wherein each one of the plurality of arms of the conductive housing can be tuned to support a different set of frequencies.

11. An antenna system in accordance with claim 10, wherein the set of frequencies associated with different ones of the plurality of arms can be used together to support carrier aggregation.

12. A antenna system in accordance with claim 1, wherein the electronic device is a hand held cellular radiotelephone.

13. An antenna system in for use in an electronic device, the antenna system comprising:

a conductive housing for the electronic device having a perimeter, which extends around the device, the conductive housing having a plurality of arms formed in the conductive housing at or near the perimeter;

a conductive substrate, coupled to the conductive housing and located within the perimeter of the conductive housing, the conductive substrate having a notch located proximate a position of one of the plurality of arms in the conductive housing, where each of the plurality of arms respectively couples to the conductive substrate proximate the perimeter, and where the notch causes one of the plurality of arms to couple to the conductive substrate at a point having a different relative distance along the length of the perimeter of the conductive housing; and a plurality of signal sources, respectively coupled between the conductive substrate and a corresponding one of the plurality of arms; and wherein at a point along the length of the arm associated with the notch, the antenna system includes an electrical circuit which couples the arm to the conductive substrate at the point along the length of the arm between where the arm directly couples to the conductive substrate and an end of the arm.

14. An antenna system in accordance with claim 13, wherein the point along the length of the arm corresponds to a distance from the end of the arm consistent with where the arm would have coupled to the conductive substrate if the conductive substrate did not have a notch.

15. An antenna system in accordance with claim 13, wherein the electrical circuit creates an alternative path for return current for a signal source of the plurality of signal sources coupled between the conductive substrate and the arm associated with the notch.

16. An antenna system in accordance with claim 13, wherein the electrical circuit includes an inductor capacitor tank circuit.

17. An antenna system in accordance with claim 16, wherein the inductor capacitor tank circuit includes a capacitor having a controllable variable value.

18. An antenna system in accordance with claim 16, wherein the electrical circuit further includes a switch in series with the inductor capacitor tank circuit for selectively coupling the arm associated with the notch to the conductive substrate via the electrical circuit.

* * * * *